US011098479B2

(12) United States Patent
Amend

(10) Patent No.: US 11,098,479 B2
(45) Date of Patent: Aug. 24, 2021

(54) EXTERIOR WALL FINISHING ARRANGEMENT

(71) Applicant: Victor Amend, Toronto (CA)

(72) Inventor: Victor Amend, Toronto (CA)

( * ) Notice: Subject to any disclaimer, the term of this patent is extended or adjusted under 35 U.S.C. 154(b) by 66 days.

(21) Appl. No.: 16/658,220

(22) Filed: Oct. 21, 2019

(65) Prior Publication Data

US 2021/0040727 A1 Feb. 11, 2021

(51) Int. Cl.

| | |
|---|---|
| ***E04B 1/76*** | (2006.01) |
| ***E04B 1/80*** | (2006.01) |
| ***E04F 13/08*** | (2006.01) |
| ***E04C 3/36*** | (2006.01) |
| ***E04B 1/62*** | (2006.01) |

(52) U.S. Cl.

CPC ..... *E04B 1/7629* (2013.01); *E04B 1/625* (2013.01); *E04B 1/7612* (2013.01); *E04B 1/7645* (2013.01); *E04B 1/80* (2013.01); *E04C 3/36* (2013.01); *E04F 13/0803* (2013.01)

(58) Field of Classification Search

CPC ..... E04B 1/7629; E04B 1/80; E04B 1/7645; E04B 1/7612; E04B 1/625; E04C 3/36; E04F 13/0803

USPC ..... 52/302.1

See application file for complete search history.

(56) References Cited

U.S. PATENT DOCUMENTS

| | | | | |
|---|---|---|---|---|
| 5,473,847 | A * | 12/1995 | Crookston | E04C 2/205 454/260 |
| 5,535,556 | A * | 7/1996 | Hughes, Jr. | E04B 1/0007 405/229 |
| 5,979,131 | A * | 11/1999 | Remmele | E04B 1/762 156/306.6 |
| 8,555,581 | B2 * | 10/2013 | Amend | E04F 13/0875 52/302.1 |
| 10,000,925 | B2 * | 6/2018 | Dahlin | E04B 2/04 |
| 2009/0007509 | A1 * | 1/2009 | Jordan | E02D 31/10 52/302.1 |
| 2015/0135623 | A1 * | 5/2015 | Garrett | E04C 2/296 52/474 |

* cited by examiner

*Primary Examiner* — Babajide A Demuren

(57) ABSTRACT

A finishing arrangement for an exterior wall of a building includes: a plurality of exterior finishing panels; and at least one support member configured to support at least a portion of the weight of the exterior finishing panels. Each exterior finishing panel includes: a foam body having an interior-facing surface and an exterior-facing surface, the interior-facing surface having a plurality of pedestals formed therein, the pedestals defining a plurality of drainage channels therebetween, the exterior-facing surface being opposite the interior-facing surface and having a plurality of slots formed therein; and a plurality of structural elements, each structural element being accommodated in a respective slot, each structural element having a fastening surface for fastening a finishing material.

17 Claims, 15 Drawing Sheets

EXTERIOR WALL FINISHING ARRANGEMENT

FIELD OF THE INVENTION

The subject application generally relates to building and construction, and in particular to an exterior wall finishing arrangement.

BACKGROUND OF THE INVENTION

In the field of building and construction, walls are constructed using framing techniques, whereby structural members such as lumber studs are used to form frames to which sheathing and typically insulation are then applied. Other wall construction methods, such as concrete wall construction or metal stud construction, may alternatively be used. The interior walls of a building may be finished with drywall or plaster, appropriately treated, and painted or wallpapered. The exterior walls of the building can also be finished in various ways, but with most techniques it is common to first apply a thin weather barrier of plastic, foil, or other material having low water permeability against the exterior of the wall, the outer layer of which may be of plywood, pressboard, chipboard, oriented strand board (OSB), or other materials. Such a weather barrier impedes the ingress of moisture due to rain, dew and other environmental phenomena towards the interior of the building, and thereby guards against moisture damage and discourages the growth of mold within the wall, for example.

With frame construction, fiberglass insulation is typically inserted between the studs against the exterior sheathing in order to insulate the walls and thereby retain desirably heated or cooled air within the building. However, with frame construction and other techniques for building, improved arrangements with increased insulation value are desirable, particularly in climates having periods of very cold or very hot weather, to improve the building's capacity for retaining desired temperatures within the building.

Exterior wall finishing arrangements have been described. For example, U.S. Pat. No. 8,555,581 to Amend describes a finishing arrangement for an exterior wall of a building includes a weather or water barrier against at least the exterior of the wall; an outer hardboard panel; an insulating foam panel between the weather or water barrier and the outer hardboard panel, the insulating foam panel attached to the outer hardboard panel and having drainage channels therein; and a drainage guide that extends from the weather or water barrier to at least the outer hardboard panel, for guiding moisture away from the wall.

Improvements are generally desired. It is therefore at least an object to provide a novel exterior wall finishing arrangement.

SUMMARY OF THE INVENTION

It should be appreciated that this summary is provided to introduce a selection of concepts in a simplified form that are further described below in the detailed description. This summary is not intended to be used to limit the scope of the claimed subject matter.

Accordingly, in one aspect, there is provided a finishing arrangement for an exterior wall of a building, comprising: a plurality of exterior finishing panels, each exterior finishing panel comprising: a foam body having an interior-facing surface and an exterior-facing surface, the interior-facing surface having a plurality of pedestals formed therein, the pedestals defining a plurality of drainage channels therebetween, the exterior-facing surface being opposite the interior-facing surface and having a plurality of slots formed therein, and a plurality of structural elements, each structural element being accommodated in a respective slot, each structural element having a fastening surface for fastening a finishing material; and at least one support member configured to support at least a portion of the weight of the exterior finishing panels.

The at least one support member may abut an underside of the plurality of exterior finishing panels.

Each support member may comprise: a first portion configured to be fastened to the exterior wall, and a second portion configured to support an underside of an exterior finishing panel. Each support member may further comprise: a third portion below the second portion, the third portion being inclined relative to the second portion for guiding moisture downward and away from the exterior wall. The second portion may comprise connecting structure for engaging a portion of the finishing material. The connecting structure may be at least one of a longitudinal recess and a hook. The length of the second portion may be greater than the length of the underside of the exterior finishing panel. The first portion and the second portion may be a unitary structure fabricated of a single piece of material.

The at least one support member may comprise a plurality of support members aligned in an end-to-end manner.

Each support member may extend the length of a single exterior finishing panel.

The finishing arrangement may further comprise a vapor barrier disposed against the exterior wall. The vapor barrier may be disposed between the exterior wall and the plurality of exterior finishing panels. A portion of the support member may be disposed between exterior sheathing and the vapor barrier.

In another aspect, there is provided an exterior finishing panel, comprising: a foam body having an interior-facing surface and an exterior-facing surface, the interior-facing surface having a plurality of pedestals formed therein, the pedestals defining a plurality of drainage channels therebetween, the exterior-facing surface being opposite the interior-facing surface and having a plurality of slots formed therein; and a plurality of structural elements, each structural element being accommodated in a respective slot, each structural element having a fastening surface for fastening a finishing material.

The pedestals may have profiles shaped as one or more of: circles, ellipses, rectangles, diamonds, squares and/or hexagons.

Each structural element may be bonded by adhesive to the foam body.

Each structural element may be embedded in the foam body, the structural element being accessible from the outward-facing surface.

Each structural element may engage the foam body by interference fit.

Each structural element may be sized such that it protrudes beyond the outward-facing surface of the foam body. Each structural element may have an outward-facing surface that is offset from the exterior-facing surface of the foam body. Each structural element may have a plurality of additional apertures formed in sidewalls thereof, the additional apertures defining a plurality of ventilation passages through the structural element.

Each structural element may comprise at least one layer of corrugated material. Each layer of corrugated material may comprise a sinusoidal or zig-zag configuration of sheet material disposed between two generally planar sheets of sheet material. Corrugations of the at least one layer of corrugated material may define a plurality of ventilation passages through the structural element.

Each structural element may be sized to have an outward-facing surface that is flush with the outward-facing surface of the foam body.

BRIEF DESCRIPTION OF THE DRAWINGS

Embodiments will now be described more fully with reference to the accompanying drawings in which.

DETAILED DESCRIPTION OF EMBODIMENTS

The foregoing summary, as well as the following detailed description of certain examples will be better understood when read in conjunction with the appended drawings. As used herein, an element or feature introduced in the singular and preceded by the word "a" or "an" should be understood as not necessarily excluding the plural of the elements or features. Further, references to "one example" or "one embodiment" are not intended to be interpreted as excluding the existence of additional examples or embodiments that also incorporate the described elements or features. Moreover, unless explicitly stated to the contrary, examples or embodiments "comprising" or "having" or "including" an element or feature or a plurality of elements or features having a particular property may include additional elements or features not having that property. Also, it will be appreciated that the terms "comprises", "has", "includes" means "including by not limited to" and the terms "comprising", "having" and "including" have equivalent meanings.

As used herein, the term "and/or" can include any and all combinations of one or more of the associated listed elements or features.

It will be understood that when an element or feature is referred to as being "on", "attached" to, "connected" to, "coupled" with, "contacting", etc. another element or feature, that element or feature can be directly on, attached to, connected to, coupled with or contacting the other element or feature or intervening elements may also be present. In contrast, when an element or feature is referred to as being, for example, "directly on", "directly attached" to, "directly connected" to, "directly coupled" with or "directly contacting" another element of feature, there are no intervening elements or features present.

It will be understood that spatially relative terms, such as "under", "below", "lower", "over", "above", "upper", "front", "back" and the like, may be used herein for ease of description to describe the relationship of an element or feature to another element or feature as illustrated in the figures. The spatially relative terms can however, encompass different orientations in use or operation in addition to the orientation depicted in the figures.

Figure 1:
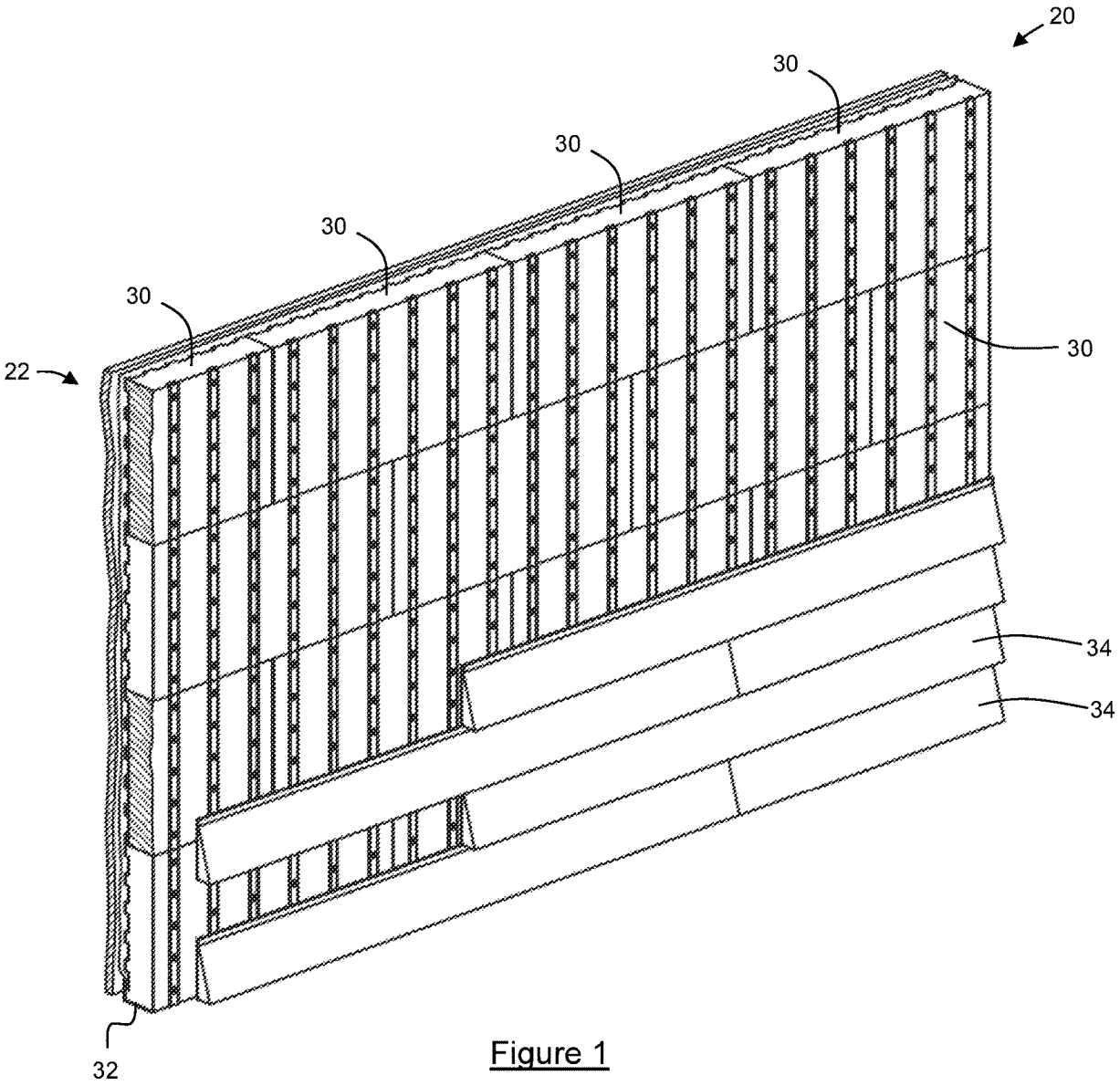
FIG. 1 is a perspective view of an exterior wall finishing arrangement.

Turning now to FIG. 1, a portion of a finishing arrangement for an exterior wall is shown and is generally indicated by reference numeral 20. Finishing arrangement 20 is fastened to an exterior wall 22 of a building, and provides an insulated fastening surface for the installation of finishing materials on the building exterior. In this embodiment, the building is a residential building, such as a house, however it will be understood that the building may alternatively be another form of building, such as a non-residential building.

The exterior wall 22 is fabricated by frame construction, and in the example shown the exterior wall 22 comprises a layer of sheathing 24, such as a board of plywood or oriented strand board (OSB) and the like, and a vapor barrier 26 fastened to an exterior surface of the sheathing 24. It will be understood that the exterior wall 22 further comprises additional components, such as a stud frame (not shown) to which the sheathing 24 is fastened.

The finishing arrangement 20 comprises a plurality of exterior finishing panels 30 and a support member 32 positioned below the exterior finishing panels 30. The exterior finishing panels 30 are configured to be arranged so as to cover a majority of the surface of the exterior wall 22. The support member 32 is configured to support a portion of the weight of the exterior finishing panels 30, and a portion of the weight of finishing materials fastened to the exterior finishing panels 30. In the example shown, the finishing materials are siding panels 34.

The exterior finishing panel 30 may be better seen in FIGS. 2 to 7. The exterior finishing panel 30 has a foam body 40 fabricated of insulating foam, and in this embodiment the foam body 40 is fabricated of expanded polystyrene (EPS) foam by molding, whereby expandable polystyrene beads (not shown) are heated in a suitably shaped mold (not shown), as is known in the art. The foam body 40 has an interior-facing surface 42, and an exterior-facing surface 44 opposite the interior-facing surface 42. The foam body 40 also has a plurality of side surfaces 46 adjacent the interior-facing surface 42 and the exterior-facing surface 44.

The interior-facing surface 42 has a plurality of pedestals 48 formed therein, which define a plurality of drainage channels 50 therebetween. The drainage channels 50 are configured to allow any moisture adjacent the interior-facing surface 42, such as condensation, to flow downward during use. In the embodiment shown, the pedestals 48 have profiles shaped as squares, however it will be understood that the pedestals may alternatively have profiles shaped differently, such as one or more of circles, ellipses, rectangles, diamonds, and/or hexagons, for example.

The foam body 40 has a plurality of slots 52 formed in the exterior facing surface 44, with each slot 52 being sized to accommodate a structural element 54. In the example shown, the slots 52 extend the height of the foam body 40, however it will be understood that the slots 52 may be differently oriented and may alternatively extend the length of the foam body 40.

Figure 7:
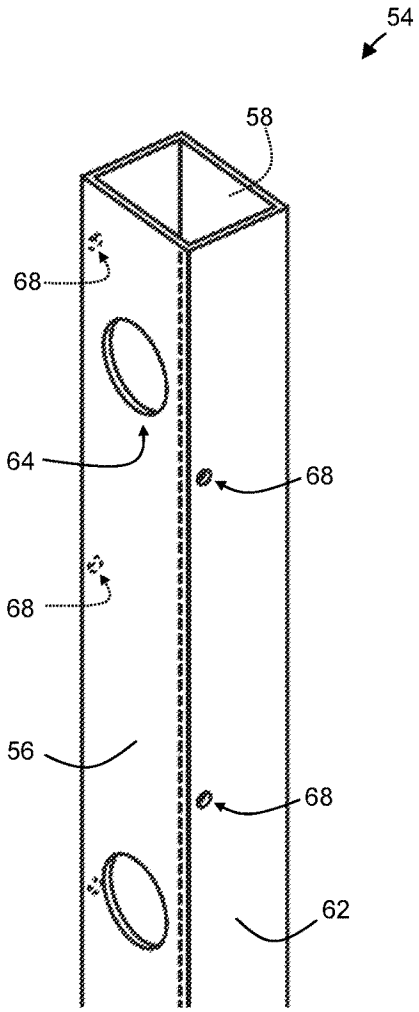
FIG. 7 is a perspective view of a portion of a structural element forming part of the exterior finishing panel of FIG. 2.

The structural element 54 may be better seen in FIG. 7. Structural element 54 is fabricated of a material having suitable strength, such as steel or another metal, plastic, wood, or a wood-plastic composite material, and has a generally tubular, box-shaped cross section. In this embodiment, the structural elements 54 are bonded to the slots 52 formed in the foam body 40 by adhesive (not shown), and the structural elements 54 thereby form part of the exterior finishing panel 30. The structural element 54 has an outward-facing surface 56, an inward-facing surface 58, and two lateral surfaces 62. A plurality of apertures 64 are formed in the outward-facing surface 56 for accommodating fasteners 66. In the example shown, the fasteners 66 are screws. As will be understood, each fastener 66 is sized to extend through the structural element 54 and the foam body 40 and into the exterior wall 22 of the building, for fastening the exterior finishing panel 30 to the exterior wall 22. Once fastened, the fasteners 66 support a portion of the weight of the exterior finishing panels 30. As will also be understood, the outward-facing surface 56 of the structural element 54 provides a fastening surface for finishing material, such as siding panel 34.

Figure 6:
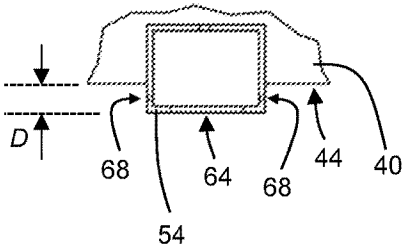
FIG. 6 is a fragmentary view of the exterior finishing panel of FIG. 5.

The structural element 54 has a thickness, defined by each lateral surface 62, that is greater than the depth of the slot 52 formed in the foam body 40. When the structural element 54 is accommodated in the slot 52, a portion of the structural element 54 protrudes by a distance D beyond the exterior-facing surface 44 of the foam body 40, as indicated in FIG. 6. As a result, any finishing material, such as siding panel 34, fastened to the structural element 54 will be spaced from the exterior-facing surface 44 of the foam body 40 by a gap corresponding to the distance D. As will be appreciated, this gap advantageously allows for ventilation between the foam body 40 and the siding panels 34.

In this embodiment, the structural element 54 also has a plurality of apertures 68 formed in the lateral surfaces 62, in the portion of the structural element 54 that protrudes beyond the exterior-facing surface 44 of the foam body 40. As will be understood, the apertures 68 advantageously allow for ventilation in a generally lateral direction between the foam body 40 and the finishing material. In the example shown, the positions of the apertures 68 on opposite lateral surfaces 62 are staggered, such that the apertures 68 define diagonal flow passages through the interior of the structural element 54, relative to the length of the structural element 54. However, it will be understood that the positions of the apertures 68 on opposite lateral surfaces 62 may alternatively be aligned, such that the apertures 68 define perpendicular flow passages through the interior of the structural element 54, relative to the length of the structural element 54.

Figure 2:
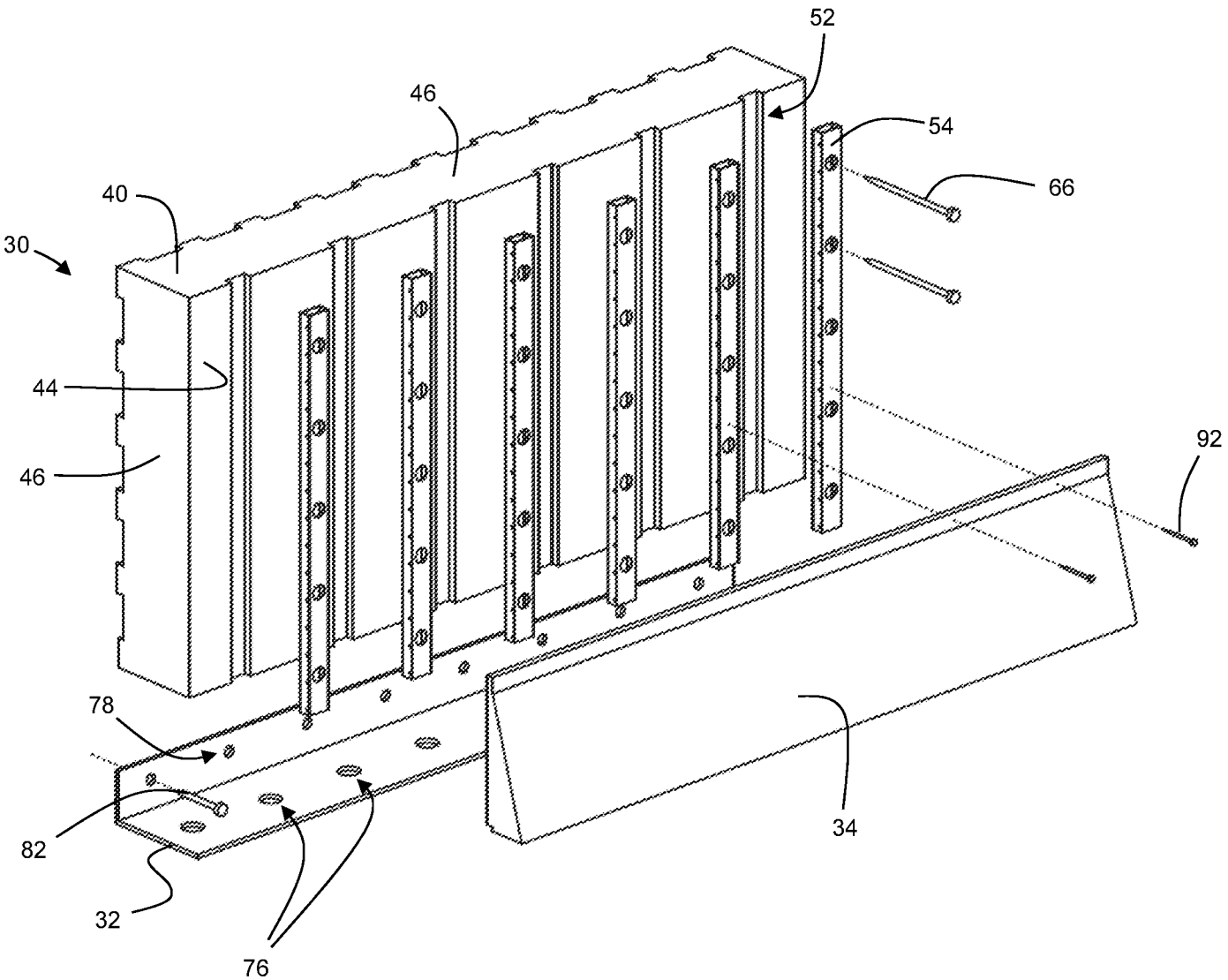
FIG. 2 is an exploded view of an exterior finishing panel and a drainage guide forming part of the exterior wall finishing arrangement of FIG. 1, and a siding panel for use therewith.
Figure 3:
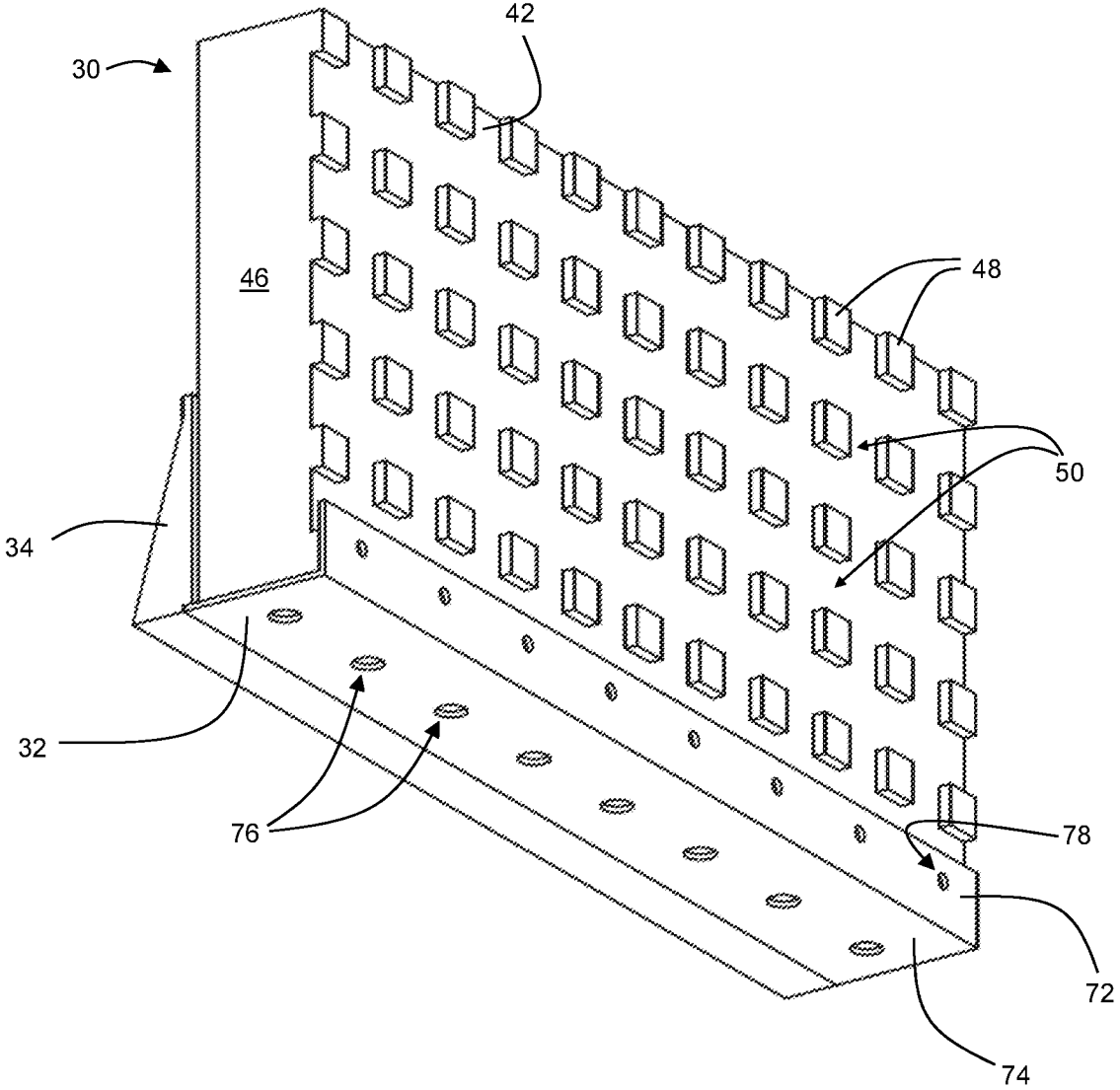
FIG. 3 is a rear perspective view of the exterior finishing panel, support member and siding panel of FIG. 2.
Figure 4:
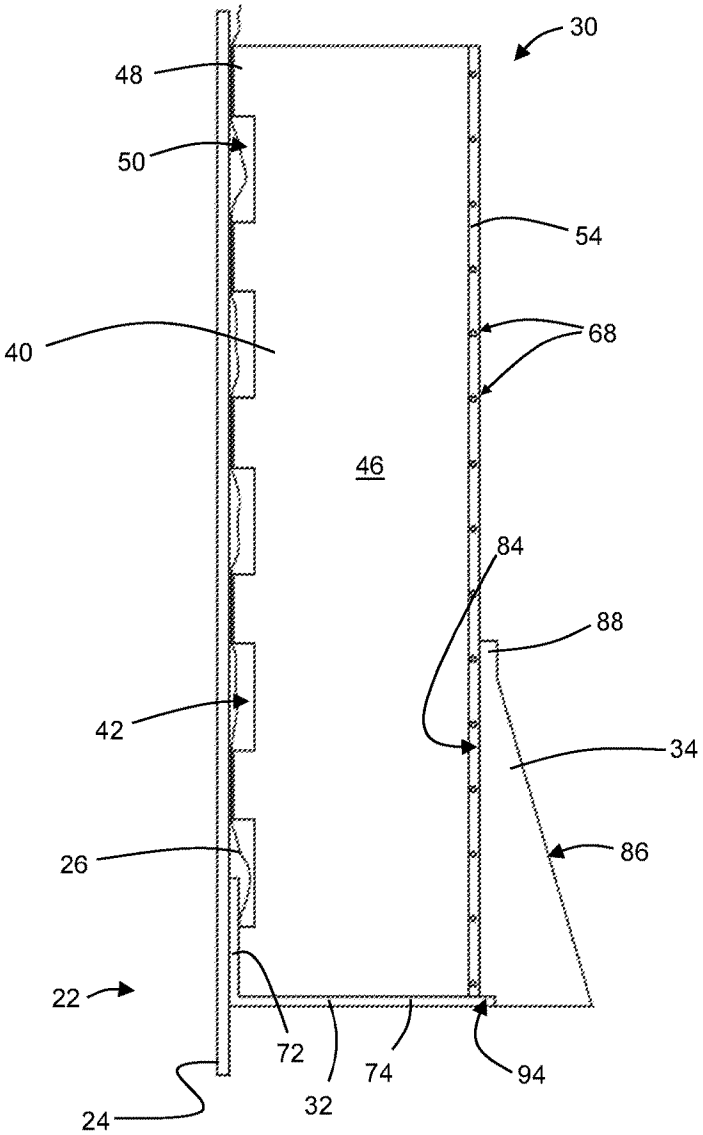
FIG. 4 is a side view of the exterior finishing panel, support member and siding panel of FIG. 2, shown installed on an exterior wall during use.
Figure 5:
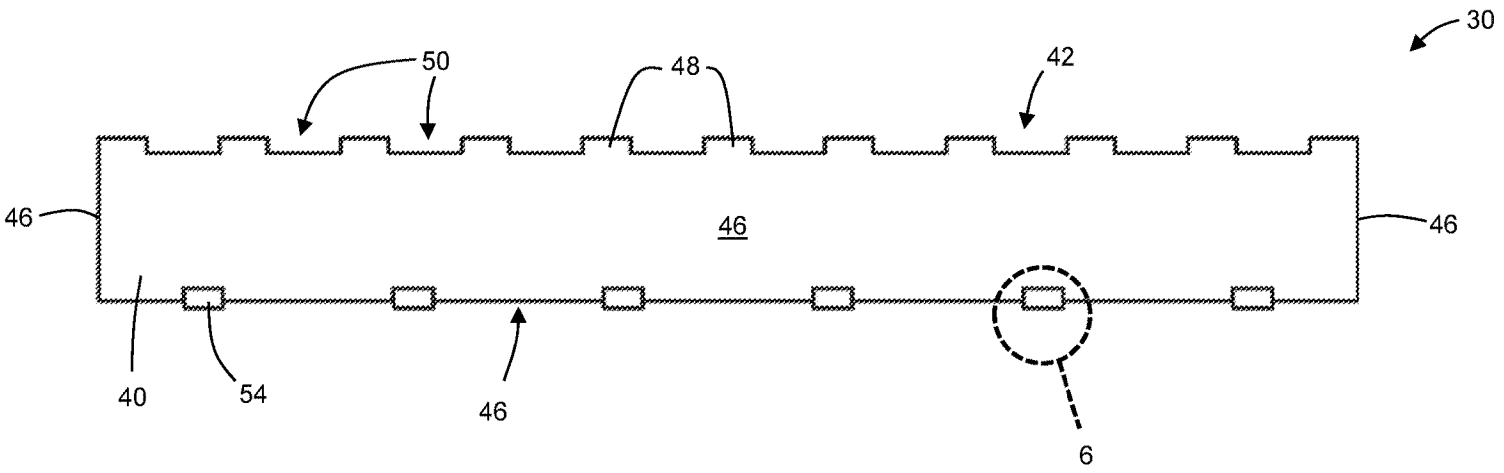
FIG. 5 is a top view of the exterior finishing panel of FIG. 2.

The support member 32 may be better seen in FIGS. 2 to 4. The support member 32 is fabricated of a material having suitable strength, such as steel or another metal, or plastic. In this embodiment, the support member 32 has a generally L-shaped cross section, and comprises a first portion 72 configured to abut the exterior wall 22, and a second portion 74 extending from the first portion 72 and configured to abut an underside of the arrangement of exterior finishing panels 30. The second portion 74 has a plurality of apertures 76 formed therein for allowing moisture to drain therethrough. The first portion 72 has a plurality of apertures 78 formed therein for accommodating fasteners 82. In the example shown, the fasteners 82 are screws. As will be understood, each fastener 82 is sized to extend through the first portion 72 into the exterior wall 22 of the building, for fastening the support member 32 to the exterior wall 22.

In the example shown, each siding panel 34 is fabricated of a material having suitable strength, such as wood, plastic, or fiber cement, and has a solid, generally tapered profile. The siding panel 34 has an interior-facing surface 84 that is configured to abut the exterior finishing panel 30, and an exterior-facing surface 86 opposite the interior-facing surface 84 that, when installed, defines an exterior surface of the building. As will be understood, the exterior-facing surface 86 is exposed to weather and the elements during use, and is sloped to permit water drainage downward along the exterior of siding panel 34. The siding panel 34 has connecting features for allowing vertically abutting siding panels 34 to engage each other in an interlocking and/or overlapping manner. In the example shown, the siding panel 34 has an upper longitudinal tab 88 that extends the length of the siding panel 34, and which is configured to receive fasteners 92. In the example shown, the fasteners 92 are nails, however it will be understood that other types of fastener such as screws may alternatively be used. As will be understood, each fastener 92 is sized to extend through the upper longitudinal tab 88 into the outward-facing surface 56 of the structural element 54, for fastening the finishing material to the exterior finishing panel 30. The siding panel 34 also has a longitudinal recess 94 that is sized to accommodate the longitudinal tab 88 of a vertically abutting siding panel 34. The longitudinal recess 92 is also sized to accommodate an end of the second portion 74 of the support member 32, when the siding panel 34 is the bottommost siding panel 34 in the arrangement.

In use, the finishing arrangement 20 is assembled by fastening at least one support member 32 to the exterior wall 22 using fasteners 82. As will be understood, two (2) or more support members 32 may be installed in an end-to-end manner to effectively provide a single support member that extends a desired length of the exterior wall 22. If a vapor barrier 26 is already in place, a lower end of the vapor barrier 26 may be lifted and tucked over and exterior to the first portion 72 of the support member 32; otherwise, a vapor barrier may then be fastened to the sheathing 24 such that its lower end is tucked over the exterior of the first portion 72 of the support member 32. As will be understood, in this manner, moisture is able to drain downward along the exterior surface of the vapor barrier 26 and onto the second portion 74 of the support member 32. Exterior finishing panels 30 are then are fastened to the exterior wall 22, above the support member 32, using fasteners 66. The fasteners 66 extend through the apertures 64 of the structural elements 54, through the foam bodies 40 of the exterior finishing panels 30, and into the exterior wall 22.

Finishing material, such as siding panels 34, may then be installed on the exterior finishing panels 30, by driving fasteners 92 through the upper longitudinal tabs 88 of the siding panels 34 into the outward-facing surfaces 56 of the structural elements 54.

Once installed, moisture that accumulates between the finishing arrangement 20 and the exterior wall 22 is able to drain downward through the drainage channels 50 of the exterior finishing panels 30 to the support member 32, and exit through the apertures 76.

As will be appreciated, the exterior finishing panels 30 provide fastening surfaces in close proximity to the finishing materials. This advantageously allows the finishing materials to be secured using short fasteners, and eliminates the need for fasteners of greater length that would otherwise be required to extend through the thickness of the entire exterior finishing panel to the exterior wall. As will be understood, such fasteners of greater length would be subjected to higher moment forces, and would otherwise provide a less secure connection of the finishing materials and would otherwise result in a loss of structural integrity over the service life of the finishing arrangement 20.

As will be appreciated, in addition to providing the fastening surfaces for the finishing materials on the exterior facing side, the exterior finishing panels 30 also provide drainage on their interior facing side. As will be understood, this configuration is structurally simple, and advantageously eliminates the need to provide an additional second panel, or an additional drainage surface or structure, between the exterior finishing panel and the exterior wall 22, in order to otherwise provide drainage.

Although in the embodiment described above, the foam body has a plurality of slots formed therein and the structural elements are bonded to the slots by adhesive, in other embodiments, the structural elements may alternatively not be bonded by adhesive and may instead be applied to and held against the foam body using the fasteners. In other embodiments, the foam body may alternatively be molded with the structural elements embedded therein, with the embedded structural elements being accessible from the concrete-facing surface of the foam body. In still other embodiments, the structural elements may alternatively be held in the slots by interference fit. For example, in one such embodiment, the slots may alternatively be sized smaller than the structural elements, so as to retain the structural elements by interference fit. In another such embodiment, the foam body may have inwardly-extending grooves or other features formed therein adjacent the slots, and the structural elements may further comprise outwardly-extending tabs for engaging the inwardly-extending grooves by interference fit.

Figure 8A:
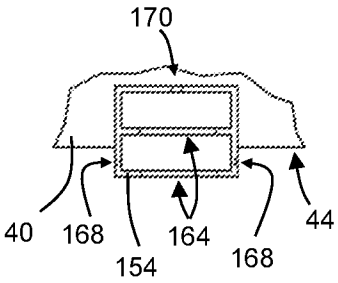
FIGS. 8A to 8G are fragmentary views of the exterior finishing panel of FIG. 5, showing other embodiments of structural elements for use therewith.
Figure 9D:
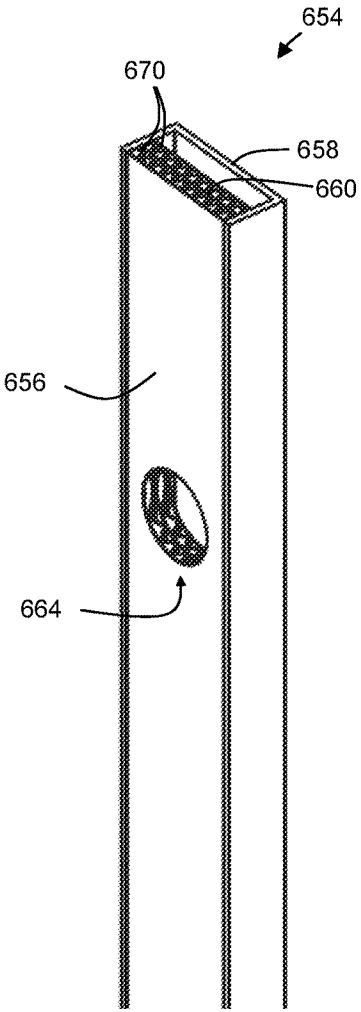
FIGS. 9A to 9D are perspective views of portions of the structural elements of FIGS. 8A, 8B, 8E and 8F, respectively.
Figure 9C:
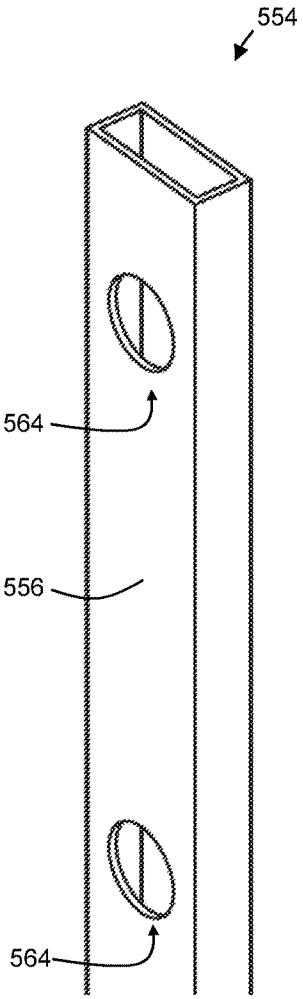

In other embodiments, the structural element may alternatively be differently configured. For example, FIGS. 8A and 9A show another embodiment of a structural element for use with the exterior finishing panel 30, and which is generally indicated by reference numeral 154. Structural element 154 is generally similar to structural element 54 described above and with reference to FIGS. 2 to 7, and has a generally tubular, box-shaped cross section comprising an outwardly-facing surface 156, but further has at least one internal stiffening rib 160 extending the length of the structural element 154. The outwardly-facing surface 156 and the at least one stiffening rib 160 have a plurality of spaced apertures 164 formed therein, which accommodate fasteners 66. The structural element 154 also has apertures 170 formed therein for accommodating the fasteners 66. As will be understood, the outwardly-facing surface 156 provides a fastening surface for finishing materials, such as siding panels 34. Additionally, the structural element 154 has a depth, defined by each sidewall 162, which is greater than the depth of the slot 52 formed in the foam body 40. When the structural element 154 is accommodated in the slot 52, a portion of the structural element 154 protrudes beyond the exterior-facing surface 44. As a result, any finishing material fastened to the structural element 154 will advantageously be spaced from the exterior-facing surface 44 of the foam body 40.

Additionally, the structural element 154 has a plurality of apertures 168 formed in the sidewalls 162, and in the portion of the structural element 154 that protrudes beyond the exterior-facing surface 44. As will be understood, the apertures 168 advantageously allow for ventilation in a generally lateral direction between the foam body 40 and the finishing material.

Figure 8B:
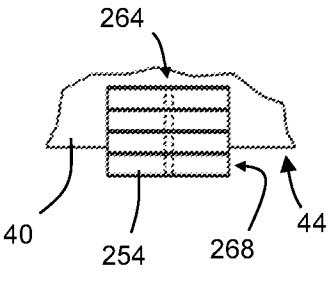
Figure 9B:
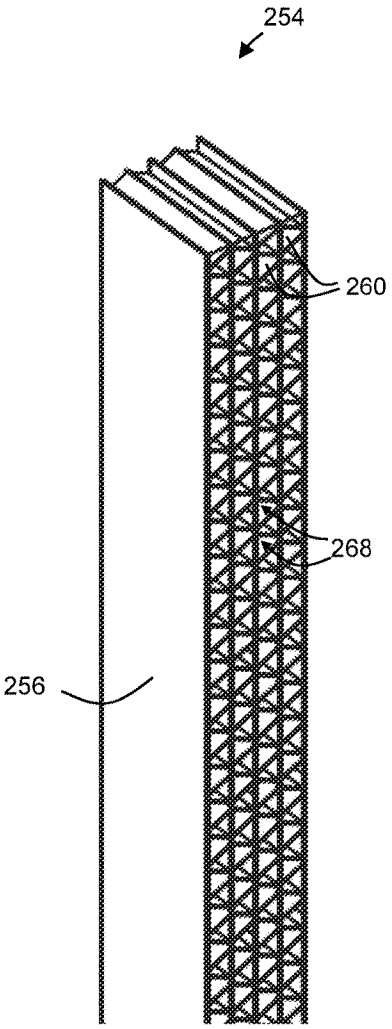
Figure 9A:
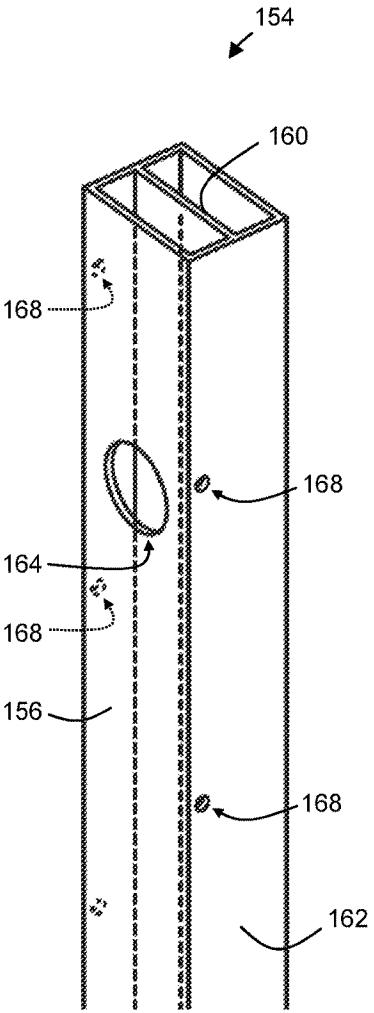

FIGS. 8B and 9B show another embodiment of a structural element for use with the exterior finishing panel 30, and which is generally indicated by reference numeral 254. Structural element 254 is fabricated of a plurality of corrugated layers 260 of a material having suitable strength, such as plastic, and for example high density polyethylene (HDPE), polypropylene (PP) or acrylonitrile butadiene styrene (ABS). In the example shown, the structural element 254 comprises four (4) layers 260 of the corrugated material, with each layer 260 comprising a sinusoidal or zig-zag configuration of sheet material sandwiched between two generally planar sheets of material, as is known in the art. The structural element 254 has an outwardly-facing surface 256, which also provides a fastening surface for finishing materials, such as siding panels 34. As will be understood, the surfaces of the sinusoidal or zig-zag configuration of sheet material sandwiched between two generally planar sheets provide multiple gripping surfaces for fasteners 92 used to fasten the finishing materials to the structural element 254. The structural element 254 has a depth that is greater than the depth of the slot 52 formed in the foam body 40. When the structural element 254 is accommodated in the slot 52, a portion of the structural element 254 protrudes beyond the exterior-facing surface 44. As a result, finishing materials, such as siding panels 34, fastened to the structural element 254 will advantageously be spaced from the exterior-facing surface 44 of the foam body 40. Similar to structural element 54, the structural element 254 has apertures 264 formed therein for accommodating fasteners 66.

As will be understood, the corrugated structure of the structural element 254 advantageously enables ventilation in a generally lateral direction between the foam body 40 and the finishing material. In the example shown, the flow passages in each layer 260 define a plurality of flow passages 268 that traverse the width of the structural element 254, and that are oriented generally perpendicularly to the length of the structural element 254. However, it will be understood that the corrugations in each layer 260 may alternatively be oriented diagonally relative to the length of the structural element 254. The structural element 254 may for example be a furring strip fabricated by Quarrix Building Products, a subsidiary of Liberty Diversified International of Minneapolis, U.S.A., and as described in U.S. Pat. Nos. 6,938,383 and 7,117,649.

Figure 8C:
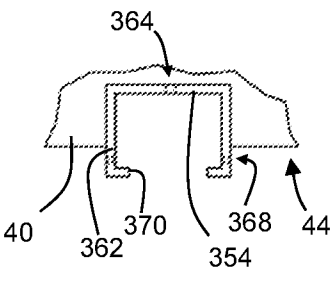

FIG. 8C shows another embodiment of a structural element for use with the exterior finishing panel 30, and which is generally indicated by reference numeral 354. Structural element 354 is generally similar to structural element 54 described above and with reference to FIGS. 2 to 7, but has a generally C-shaped cross section comprising inwardly extending flanges 370. As will be understood, the flanges 370 provide fastening surfaces for finishing materials, such as siding panels 34. Additionally, the structural element 354 has a depth, defined by each sidewall 362, that is greater than the depth of the slot 52 formed in the foam body 40. When the structural element 354 is accommodated in the slot 52, a portion of the structural element 354 protrudes beyond the exterior-facing surface 44. As a result, finishing materials, such as siding panels 34, fastened to the structural element 354 will advantageously be spaced from the exterior-facing surface 44 of the foam body 40. Similar to structural element 54, the structural element 354 has apertures 364 formed therein for accommodating fasteners 66.

Additionally, the structural element 354 has a plurality of apertures 368 formed in the sidewalls 362, and in the portion of the structural element 354 that protrudes beyond the exterior-facing surface 44. As will be understood, the apertures 368 advantageously allow for ventilation in a generally lateral direction between the foam body 40 and the finishing material.

Figure 8D:
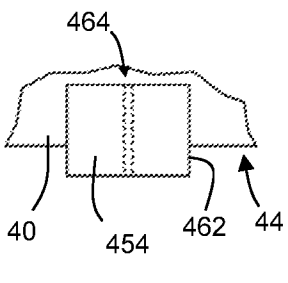

FIG. 8D shows another embodiment of a structural element for use with the exterior finishing panel 30, and which is generally indicated by reference numeral 454. Structural element 454 has a solid, generally rectangular cross section comprising an outwardly-facing surface 456. The structural element 454 is fabricated of a suitable material such as wood, metal, or plastic, such as high density polyethylene (HDPE), polypropylene (PP) or acrylonitrile butadiene styrene (ABS), and has apertures 464 formed therein for accommodating fasteners 66.

As will be understood, the outwardly-facing surface 456 of structural element 454 provides a fastening surface for finishing materials, such as siding panels 34. Additionally, the structural element 454 has a depth, defined by each sidewall 462, that is greater than the depth of the slot 52 formed in the foam body 40. Owing to the thickness of the structural element 454, when the structural element 454 is accommodated in the slot 52, a portion of the structural element 454 protrudes by a distance D beyond the exterior-facing surface 44. As a result, finishing materials, such as siding panels 34, fastened to the structural element 454 will advantageously be spaced from the exterior-facing surface 44 of the foam body 40 by a gap corresponding to the distance D. As will be appreciated, this gap advantageously allows for ventilation between the foam body 40 and the finishing material.

Figure 8E:
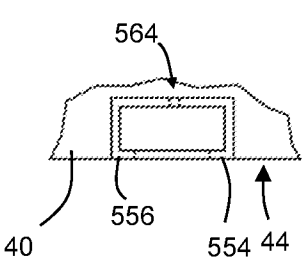

FIGS. 8E and 9C show another embodiment of a structural element for use with the exterior finishing panel 30, and which is generally indicated by reference numeral 554. Structural element 554 is generally similar to structural element 54 described above and with reference to FIGS. 2 to 7, and has a generally tubular, box-shaped cross section comprising an outwardly-facing surface 556. The outwardly-facing surface 556 has a plurality of spaced apertures 564 formed therein for accommodating fasteners 66. As will be understood, the outwardly-facing surface 556 provides a fastening surface for finishing materials, such as siding panels 34.

The structural element 554 has a thickness that is generally commensurate with the depth of the slot 52 formed in the foam body 40. As a result, when the structural element 554 is accommodated in the slot 52, the outwardly-facing surface 556 is generally flush with the exterior-facing surface 44 of the foam body 40.

Figure 8F:
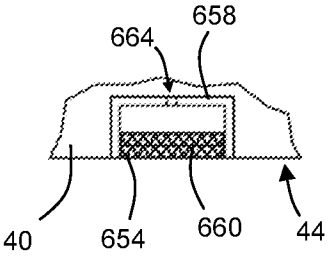
Figure 8G:
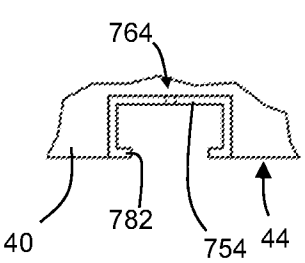

FIGS. 8F and 9D show another embodiment of a structural element for use with the exterior finishing panel 30, and which is generally indicated by reference numeral 654. Structural element 654 comprises a first portion 658 having a generally C-shaped cross section that is fabricated of a material having suitable strength, such as steel or another metal, or plastic. Similar to structural element 54, the first portion 658 has apertures 664 formed therein for accommodating fasteners 66. The structural element 654 further comprises a second portion 660 joined or bonded to an opening of the first portion 658, and which is fabricated of at least one corrugated layer 670 of a material having suitable strength, such as plastic, and for example high density polyethylene (HDPE), polypropylene (PP) or acrylonitrile butadiene styrene (ABS). In the example shown, the second portion 660 comprises two (2) layers 670 of the corrugated material, with each layer 670 comprising a sinusoidal or zig-zag configuration of sheet material sandwiched between two generally planar sheets of material. The second portion 660 has an outwardly-facing surface 656 with a plurality of spaced apertures 664 formed therein for accommodating fasteners 66. As will be understood, the outwardly-facing surface 656 also provides a fastening surface for finishing materials, such as siding panels 34. As will also be understood, the surfaces of the sinusoidal or zig-zag configuration of sheet material sandwiched between two generally planar sheets provide multiple gripping surfaces for the fasteners 92 used to fasten the finishing materials to the structural element 654, which advantageously allows the finishing materials to be more strongly fastened.

The structural element 654 has a thickness that is generally commensurate with the depth of the slot 52 formed in the foam body 40. When the structural element 654 is accommodated in the slot 52, the outwardly-facing surface 656 is generally flush with the exterior-facing surface 44 of the foam body 40.

FIG. 7G shows another embodiment of a structural element for use with the exterior finishing panel 30, and which is generally indicated by reference numeral 750. Structural element 750 is generally similar to structural element 354 described above and with reference to FIG. 7C, and has a generally C-shaped cross section comprising inwardly extending flanges 782. As will be understood, the outwardly-facing surfaces of the flanges 782 provide fastening surfaces for finishing materials, such as siding panels 34. Similar to structural element 354, the structural element 750 has apertures 772 formed therein for accommodating fasteners 66. The structural element 750 has a thickness that is generally commensurate with the depth of the slot 52 formed in the foam body 40. When the structural element 750 is accommodated in the slot 52, the outwardly-facing surfaces of the flanges 782 are generally flush with the exterior-facing surface 44 of the foam body 40.

Figure 10:
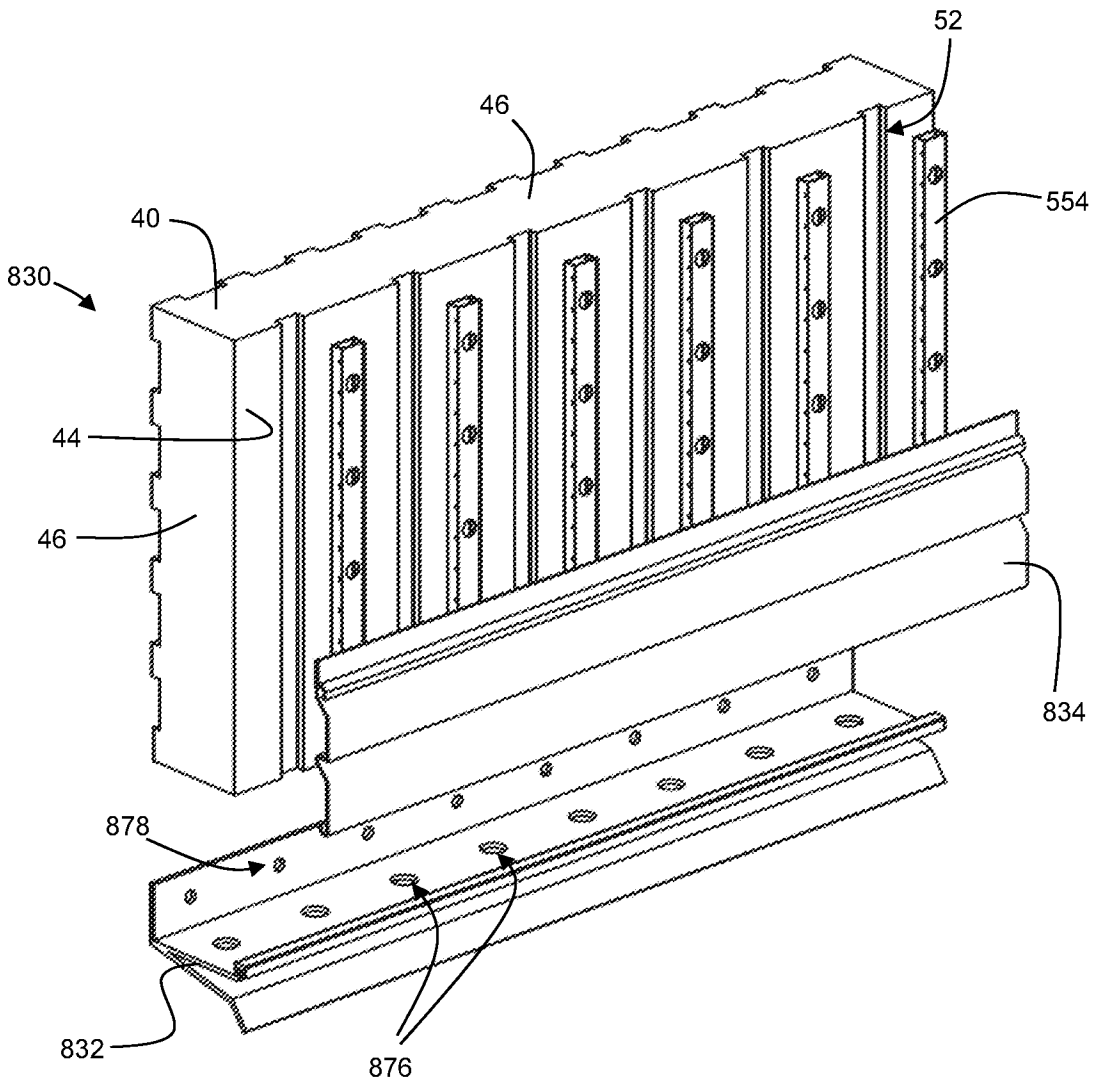
FIG. 10 is an exploded view of another embodiment of an exterior finishing panel, a support member, and a siding panel.
Figure 11:
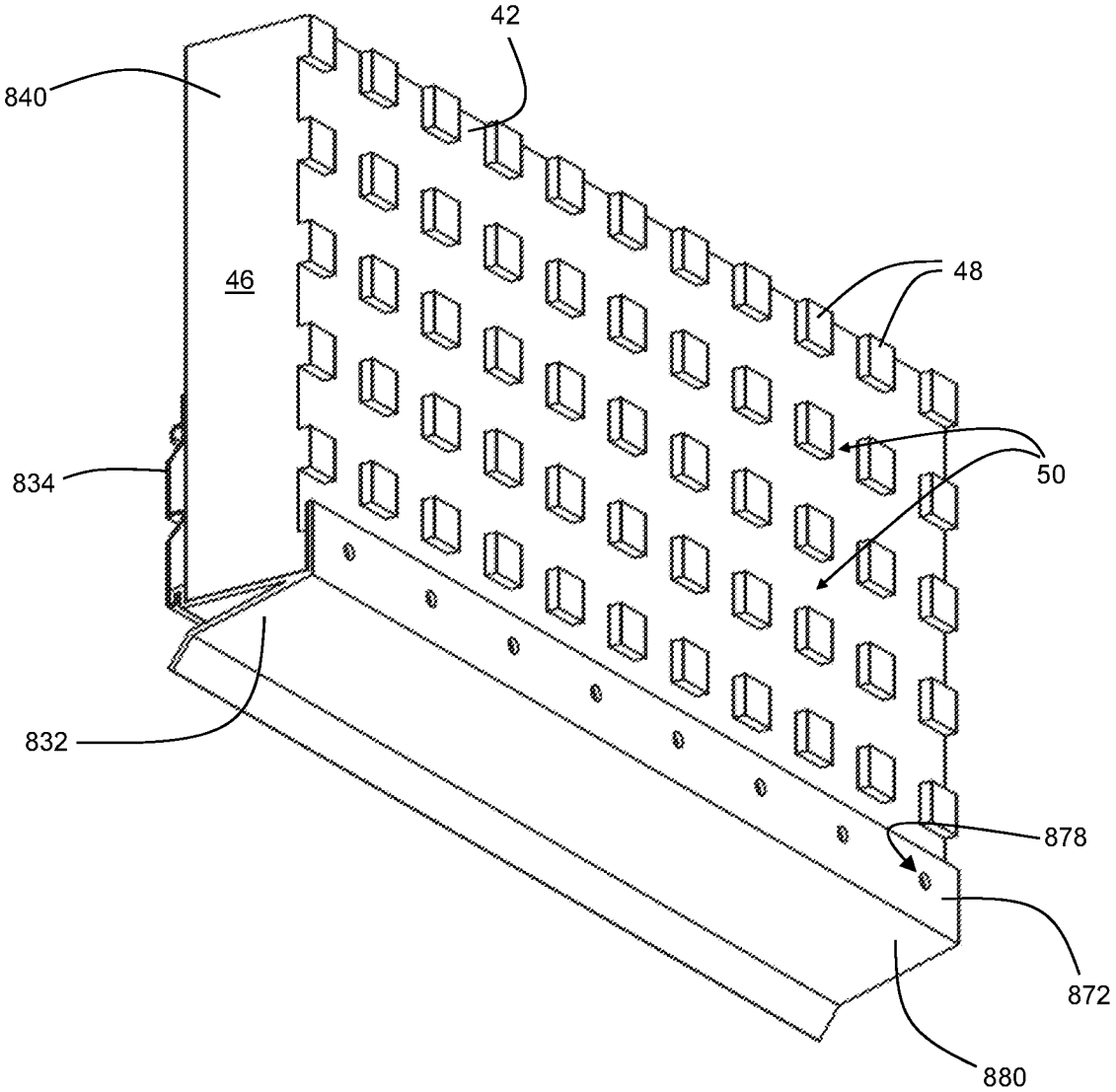
FIG. 11 is a rear perspective view of the exterior finishing panel, support member and siding panel of FIG. 10.
Figure 12:
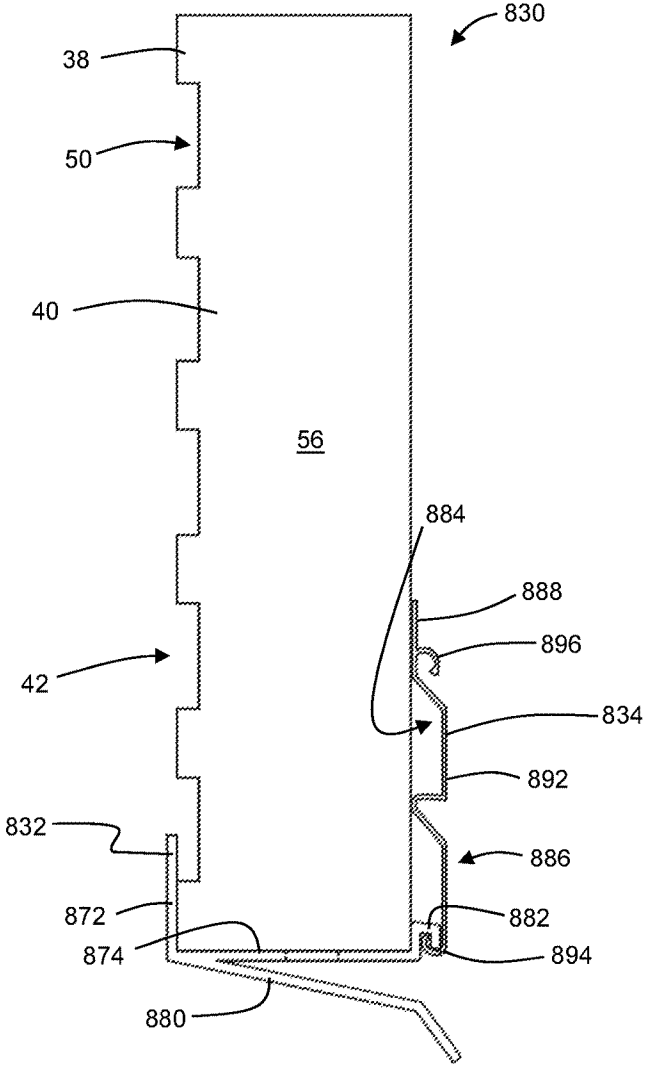
FIG. 12 is a side view of the exterior finishing panel, support member and siding panel of FIG. 10.

In other embodiments, the support member and the finishing materials may be differently configured. For example, FIGS. 10 to 12 show another embodiment of a support member for use with the finishing arrangement 20, and which is generally indicated by reference numeral 832. Support member 832 is similar to support member 32 described above and with reference to FIGS. 2 to 4, and is configured to support a portion of the weight of exterior finishing panels 830, and a portion of the weight of finishing materials fastened to the exterior finishing panels 830. In the example shown, the finishing materials are siding panels 834.

The support member 832 is fabricated of a material having suitable strength, such as steel or another metal, or plastic. In this embodiment, the support member 832 has a generally L-shaped cross section, and comprises a first portion 872 configured to abut the exterior wall 22, and a second portion 874 extending from the first portion 872 and configured to abut an underside of the arrangement of exterior finishing panels 830. The second portion 874 has a plurality of apertures 876 formed therein for allowing moisture to drain therethrough. The first portion 872 has a plurality of apertures 878 formed therein for accommodating fasteners 82. In the example shown, the fasteners 82 are screws. As will be understood, each fastener 82 is sized to extend through the first portion 872 into the exterior wall 22 of the building, for fastening the support member 832 to the exterior wall 22.

In this embodiment, the support member 832 comprises a longitudinal recess 882 that extends along the distal end of the first portion 872. The longitudinal recess 882 is configured to engage a portion of the siding panel 834, for connecting the siding panel 834 to the support member 832. The support member 832 further comprises a third portion 880 below the second portion 874, and which is configured to receive moisture flowing downward through apertures 876. As will be understood, the third portion 880 of the support member 832 is sloped, so as to guide the moisture generally downward and away from the exterior wall 22.

The exterior finishing panel 830 is generally similar to exterior finishing panel 30 described above and with reference to FIGS. 2 to 7, and comprises the foam body 40 having the interior-facing surface 42 that has a plurality of pedestals 48 formed therein and defining a plurality of drainage channels 50 therebetween, and having the plurality of slots 52 formed in the exterior facing surface 44.

In this embodiment, each slot 52 accommodates a structural element 554, which has been described above and with reference to FIGS. 8E and 9C. The structural element 554 has a thickness that is generally commensurate with the depth of the slot 52 formed in the foam body 40. As a result, when the structural element 554 is accommodated in the slot 52, the outwardly-facing surface 556 is generally flush with the exterior-facing surface 44 of the foam body 40.

The siding panel 834 is fabricated of a material having suitable strength, such as aluminum or plastic, and has an extruded or molded extrusion profile that extends the length of the siding panel 834. The siding panel 834 comprises an interior-facing surface 884, and an exterior-facing surface 886 opposite the interior-facing surface 884 that, when installed, defines an exterior surface of the building. As will be understood, the exterior-facing surface 886 is exposed to weather and the elements during use, and is vertical or sloped in areas to permit water drainage downward along the exterior of the siding panel 834. The siding panel 834 has connecting features for allowing vertically abutting siding panels 834 to engage each other in an interlocking and/or overlapping manner. In particular, the siding panel 834 comprises an upper longitudinal tab 888 that is configured to abut the exterior finishing panel 830, and which is configured to receive fasteners 92. As will be understood, each fastener 92 is sized to extend through the upper longitudinal tab 888 into the outward-facing surface 552 of the structural element 554, for fastening the finishing material to the exterior finishing panel 830. The siding panel 34 also has paneled portions 892, that are configured to be spaced from the exterior finishing panel 830 and which define a generally "slatted" appearance of the siding panel 834; a lower hook 894 depending from the paneled portion 892, and an upper hook 896 extending from the upper tab 888. The upper hook 896 is sized to engage the lower hook 894 of a vertically adjacent siding panel 834. The lower hook 894 is also sized to engage the longitudinal recess 882 of the support member 832, when the siding panel 834 is the bottommost siding panel 834 in the arrangement.

In use, the finishing arrangement 20 is assembled by fastening at least one support member 832 to the exterior wall 22 using fasteners 82. As will be understood, two (2) or more support members 832 may be installed in an end-to-end manner to effectively provide a single support member that extends a desired length of the exterior wall 22. If a vapor barrier 26 is already in place, a lower end of the vapor barrier 26 may be lifted and tucked over and exterior to the first portion 872 of the support member 832; otherwise, a vapor barrier 26 may then be installed on the exterior wall 22 such that its lower end is tucked over the exterior of the first portion 872 of the support member 832. As will be understood, in this manner, moisture is able to drain downward along the exterior surface of the vapor barrier 26 and onto the second portion 874 of the support member 832. Exterior finishing panels 830 are then are fastened to the exterior wall 22, above the support member 32, using fasteners 66. The fasteners 66 extend through the apertures 558 of the structural elements 550, through the foam bodies 40 of the exterior finishing panels 830, and into the exterior wall 22.

Finishing material, such as siding panels 834, may then be installed on the exterior finishing panels 30, by engaging the lower hook 894 with the longitudinal recess 882 of the one or more support members 832 (in the event that the siding panel is a bottommost siding panel 834) or by engaging the lower hook 894 with the upper hook 896 of a vertically adjacent siding panel 834, and by driving fasteners 92 through the upper longitudinal tabs 886 of the siding panels 834 into the outward-facing surface 556 of the structural element 554.

Figure 13:
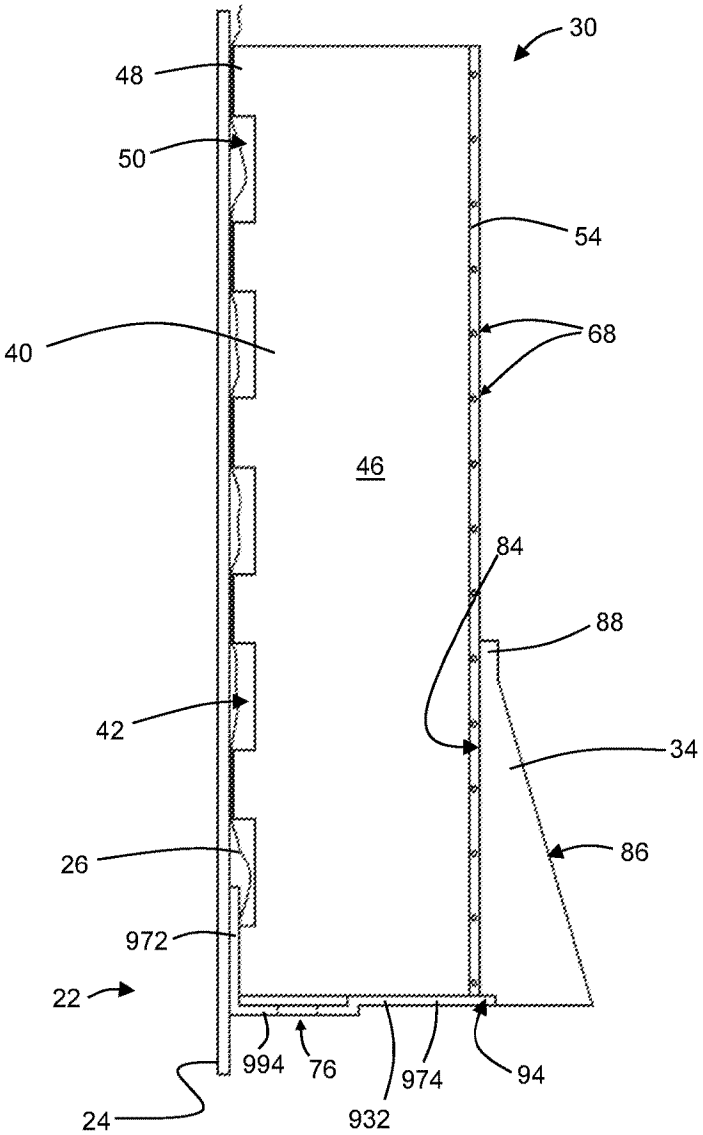
FIG. 13 is a side view of another embodiment of a support member, with the exterior finishing panel and the siding panel of FIG. 2, shown installed on an exterior wall during use.

Still other configurations are possible. For example, FIG. 13 shows another embodiment of a support member for use with the exterior finishing panel 30 and the siding panel 34, and which is generally indicated by reference numeral 932. Support member 932 is generally similar to support member 32 described above and with reference to FIGS. 2 to 4, and comprises a first portion 972 configured to abut the exterior wall 22, and a second portion 974 extending from the first portion 972 and configured to abut an underside of the arrangement of exterior finishing panels 30. The second portion 974 has a recessed surface 994 that extends the length of the support member 932, and which has a plurality of apertures 76 formed therein for allowing moisture to drain therethrough. As will be understood, during use, the recessed surface 994 is spaced from the underside of the arrangement of exterior finishing panels 30, and thereby defines a drainage channel underneath the exterior finishing panels 30 in which moisture can collect and eventually drain. Additionally, as can be seen, an end of the second portion 974 is configured to engage the longitudinal recess 92 of the siding panel 34. The first portion 972 has a plurality of apertures (not shown) formed therein for accommodating fasteners 82. As will be understood, each fastener 82 is sized to extend through the first portion 972 into the exterior wall 22 of the building, for fastening the support member 932 to the exterior wall 22.

Figure 14:
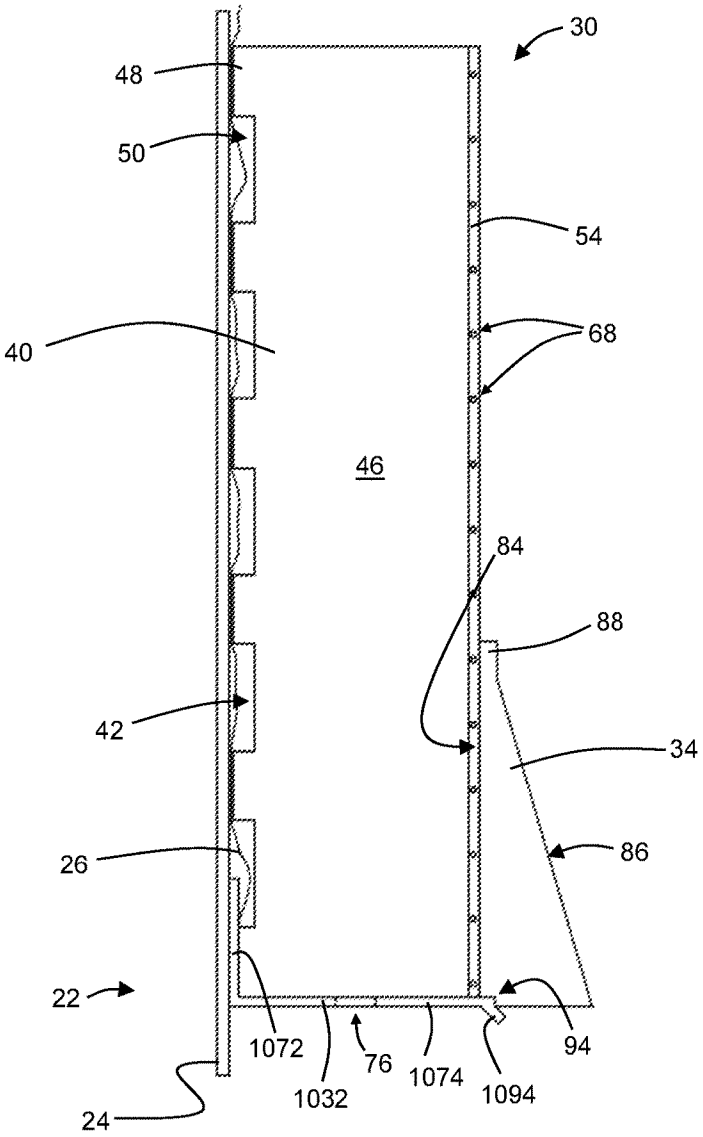
FIG. 14 is a side view of still another embodiment of a support member, with the exterior finishing panel and the siding panel of FIG. 2, shown installed on an exterior wall during use.

FIG. 14 shows another embodiment of a support member for use with the exterior finishing panel 30 and the siding panel 34, and which is generally indicated by reference numeral 1032. Support member 1032 is generally similar to support member 32 described above and with reference to FIGS. 2 to 5, and comprises a first portion 1072 configured to abut the exterior wall 22, and a second portion 1074 extending from the first portion 1072 and configured to abut an underside of the arrangement of exterior finishing panels 30. The second portion 1074 has a plurality of apertures 76 formed therein for allowing moisture to drain therethrough. An end of the second portion 1074 is configured to engage the longitudinal recess 92 of the siding panel 34. In this embodiment, the support member 1032 further comprises a drainage guide 1094 extending generally downwardly and away from a distal side of the second portion 1074. As will be understood, the drainage guide 1094 is sloped, so as to guide the moisture generally downward and away from the exterior wall 22. The first portion 1072 has a plurality of apertures (not shown) formed therein for accommodating fasteners 82. As will be understood, each fastener 82 is sized to extend through the first portion 1072 into the exterior wall 22 of the building, for fastening the support member 1032 to the exterior wall 22.

Figure 15:
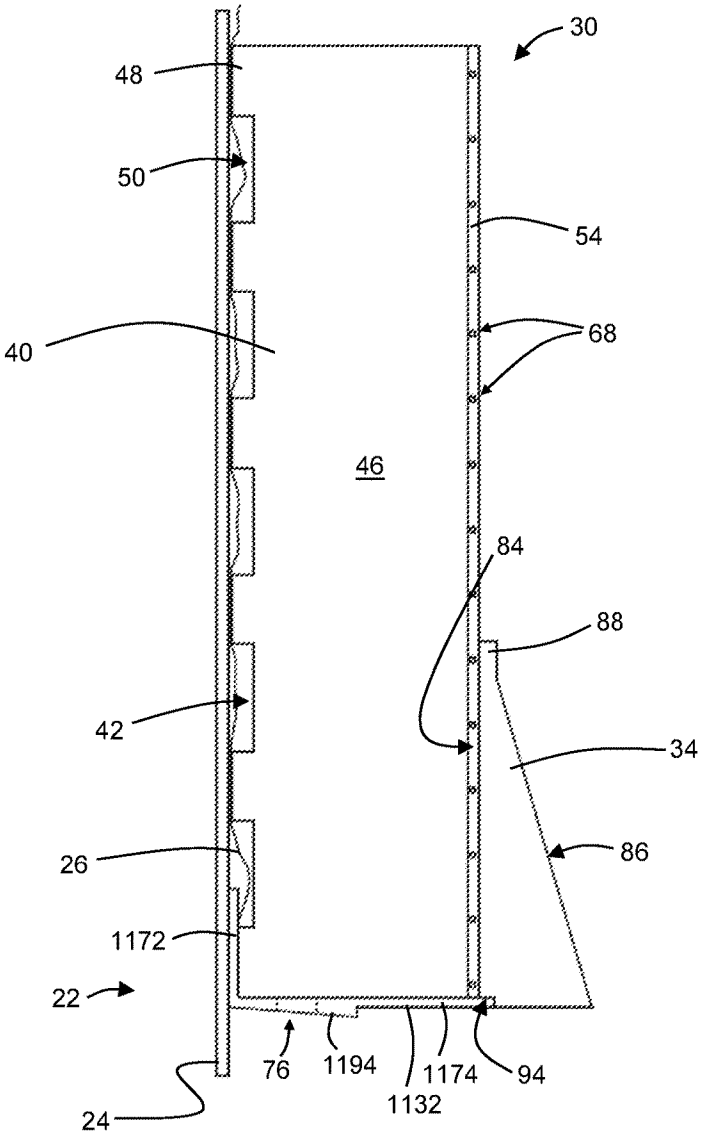
FIG. 15 is a side view of yet another embodiment of a support member, with the exterior finishing panel and the siding panel of FIG. 2, shown installed on an exterior wall during use.

FIG. 15 shows another embodiment of a support member for use with the exterior finishing panel 30 and the siding panel 34, and which is generally indicated by reference numeral 1132. Support member 1132 is generally similar to support member 32 described above and with reference to FIGS. 2 to 5, and comprises a first portion 1172 configured to abut the exterior wall 22, and a second portion 1174 extending from the first portion 1172 and configured to abut an underside of the arrangement of exterior finishing panels 30. The second portion 1174 has a plurality of apertures 76 formed therein for allowing moisture to drain therethrough. An end of the second portion 1174 is configured to engage the longitudinal recess 92 of the siding panel 34. In this embodiment, the support member 1132 further comprises a downwardly oriented drainage guide 1194 formed on an underside of the second portion 1174. As will be understood, the drainage guide 1194 has a downwardly inclined lower surface, so as to prevent moisture from receding backwards and reaching the exterior wall 22. The first portion 1172 has a plurality of apertures (not shown) formed therein for accommodating fasteners 82. As will be understood, each fastener 82 is sized to extend through the first portion 1172 into the exterior wall 22 of the building, for fastening the support member 1032 to the exterior wall 22.

Figure 16:
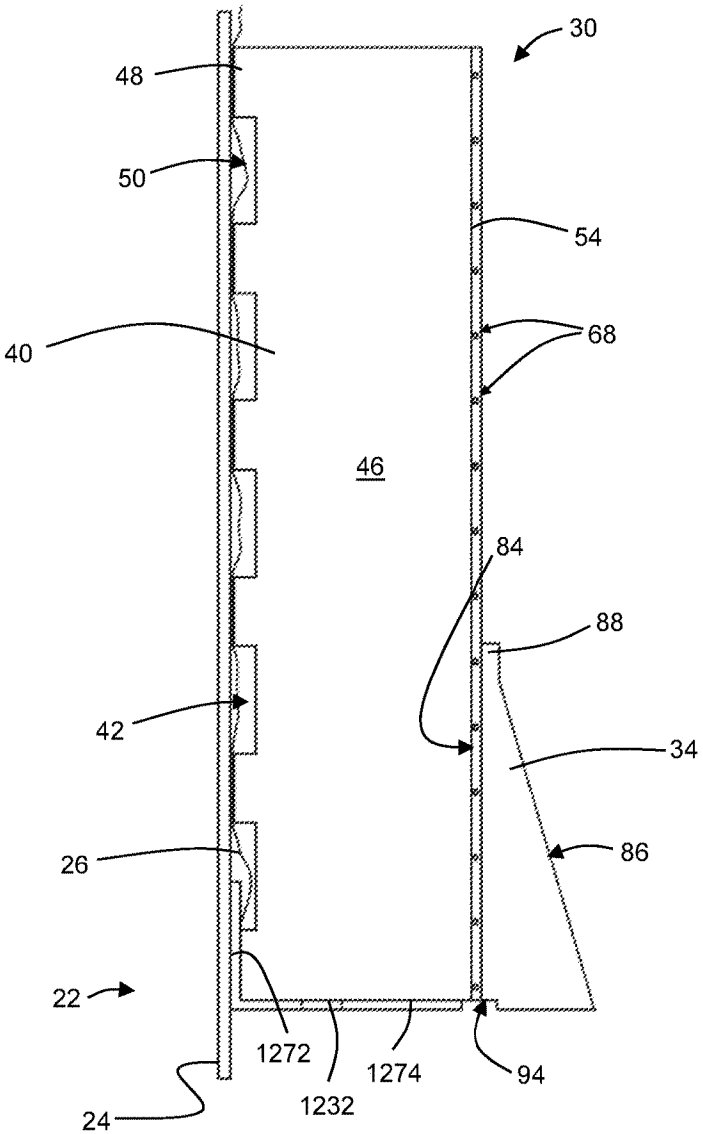
FIG. 16 is a side view of still yet another embodiment of a support member, with the exterior finishing panel and the siding panel of FIG. 2, shown installed on an exterior wall during use.

FIG. 16 shows another embodiment of a support member for use with the exterior finishing panel 30 and the siding panel 34, and which is generally indicated by reference numeral 1232. Support member 1232 is generally similar to support member 32 described above and with reference to FIGS. 2 to 5, and comprises a first portion 1272 configured to abut the exterior wall 22, and a second portion 1274 extending from the first portion 1272 and configured to abut an underside of the arrangement of exterior finishing panels 30. In this embodiment, the second portion is sized such that it does not contact the siding panel 34. The second portion 1274 has a plurality of apertures 76 formed therein for allowing moisture to drain therethrough. The first portion 1272 has a plurality of apertures (not shown) formed therein for accommodating fasteners 82. As will be understood, each fastener 82 is sized to extend through the first portion 1272 into the exterior wall 22 of the building, for fastening the support member 1232 to the exterior wall 22.

Although in the embodiments described above, the foam body of the exterior finishing panel is fabricated of EPS foam, in other embodiments, the foam body may alternatively be fabricated of another suitable foam material, such as for example extruded polystyrene (XPS) foam.

Although in the embodiments described above, the foam body of the exterior finishing panel is formed by molding, in other embodiments, the foam body may alternatively be formed by cutting the foam body from a larger block of already-molded foam, such as EPS foam, XPS foam, and the like.

Although in embodiments described above, the structural element has a plurality of apertures formed in the sidewalls, in the portion of the structural element that protrudes beyond the outward-facing surface, for allowing ventilation in a generally lateral direction between the concrete form panel and the finishing material, in other embodiments, the structural element may alternatively have only a single aperture, or a single elongate or slot-shaped opening, formed in each sidewall in the portion of the structural element that protrudes beyond the outward-facing surface, both of which thereby define only a single flow passage through the structural element.

Although embodiments have been described above with reference to the accompanying drawings, those of skill in the art will appreciate that variations and modifications may be made without departing from the scope thereof as defined by the appended claims.

What is claimed is:

1. A finishing arrangement for an exterior wall of a building, comprising:

a plurality of exterior finishing panels, each exterior finishing panel comprising:

a foam body having an interior-facing surface and an exterior-facing surface, the interior-facing surface having a plurality of pedestals formed therein, the pedestals defining a plurality of drainage channels therebetween, the exterior-facing surface being opposite the interior-facing surface and having a plurality of slots formed therein, and a plurality of structural elements, each structural element being accommodated in a respective slot, each structural element having a fastening surface for fastening a finishing material, wherein each structural element is sized such that it protrudes beyond the outward-facing surface of the foam body, and wherein each structural element has a plurality of apertures formed in sidewalls thereof, the apertures defining at least one ventilation passage through the structural element; and at least one support member configured to support at least a portion of the weight of the exterior finishing panels.

2. The finishing arrangement of claim 1, wherein the at least one support member abuts an underside of the plurality of exterior finishing panels.

3. The finishing arrangement of claim 1, wherein each support member comprises:

a first portion configured to be fastened to the exterior wall, and a second portion configured to support an underside of an exterior finishing panel.

4. The finishing arrangement of claim 3, wherein each support member further comprises:

a third portion below the second portion, the third portion being inclined relative to the second portion for guiding moisture downward and away from the exterior wall.

5. The finishing arrangement of claim 3, wherein the second portion comprises connecting structure for engaging a portion of the finishing material.

6. The finishing arrangement of claim 5, wherein the connecting structure is at least one of a longitudinal recess and a hook.

7. The finishing arrangement of claim 3, wherein the length of the second portion is greater than the length of the underside of the exterior finishing panel.

8. The finishing arrangement of claim 3, wherein the first portion and the second portion are a unitary structure fabricated of a single piece of material.

9. The finishing arrangement of claim 1, wherein the at least one support member comprises a plurality of support members aligned in an end-to-end manner.

10. The finishing arrangement of claim 1, wherein each support member extends the length of a single exterior finishing panel.

11. The finishing arrangement of claim 1, further comprising a vapor barrier disposed against the exterior wall.

12. The finishing arrangement of claim 11, wherein the vapor barrier is disposed between the exterior wall and the plurality of exterior finishing panels.

13. The finishing arrangement of claim 11, wherein a portion of the support member is disposed between exterior sheathing and the vapor barrier.

14. An exterior finishing panel, comprising:

a foam body having an interior-facing surface and an exterior-facing surface, the interior-facing surface having a plurality of pedestals formed therein, the pedestals defining a plurality of drainage channels therebetween, the exterior-facing surface being opposite the interior-facing surface and having a plurality of slots formed therein; and a plurality of structural elements, each structural element being accommodated in a respective slot, each structural element having a fastening surface for fastening a finishing material, wherein each structural element is sized such that it protrudes beyond the outward-facing surface of the foam body, and wherein each structural element has a plurality of apertures formed in sidewalls thereof, the apertures defining at least one ventilation passage through the structural element.

15. The exterior finishing panel of claim 14, wherein the pedestals have profiles shaped as one or more of: circles, ellipses, rectangles, diamonds, squares and/or hexagons.

16. The exterior finishing panel of claim 14, wherein each structural element has an outward-facing surface that is offset from the exterior-facing surface of the foam body.

17. The exterior finishing panel of claim 14, wherein each structural element comprises a plurality of layers of corrugated material.

* * * * *